US005762195A

United States Patent [19]

Stevens

[11] Patent Number: 5,762,195

[45] Date of Patent: Jun. 9, 1998

[54] FOOD AND BEVERAGE CONTAINER NESTING DEVICE

[76] Inventor: John J. Stevens, 123 Farmedge Rd., Levittown, N.Y. 11756

[21] Appl. No.: 772,823

[22] Filed: Dec. 24, 1996

Related U.S. Application Data

[63] Continuation of Ser. No. 321,003, Oct. 5, 1994, abandoned.

[51] Int. Cl.[6] ..... B65D 65/04

[52] U.S. Cl. ..... 206/499; 206/516

[58] Field of Search ..... 206/499, 516

[56] References Cited

U.S. PATENT DOCUMENTS

| | | | |
|---|---|---|---|
| 992,471 | 5/1911 | Baldwin | 206/516 |
| 1,383,779 | 7/1921 | Workman | 206/516 |
| 2,064,826 | 12/1936 | Gabriel | 220/489 |
| 2,812,098 | 11/1957 | Escaut | 220/489 |
| 3,229,843 | 1/1966 | Billion | 220/489 |
| 3,358,878 | 12/1967 | Ostborg et al. | 206/516 |
| 3,896,928 | 7/1975 | Forté | 206/516 |
| 4,407,414 | 10/1983 | Rey et al. | 206/516 |

*Primary Examiner*—Joseph M. Moy
*Attorney, Agent, or Firm*—Anderson, Kill & Olick, P.C.

[57] ABSTRACT

A container nesting device comprises a base and a plurality of resilient flexible spokes emanating from and forming the base for supporting a plurality of containers, one container above another in a spaced relationship without damaging the inside surface of the container and to prevent the containers from binding together.

15 Claims, 2 Drawing Sheets

FOOD AND BEVERAGE CONTAINER NESTING DEVICE

This is a continuation of application Ser. No. 08/321,003, filed Oct.5, 1994.

FIELD OF THE INVENTION

The present invention is directed to nesting devices and more specifically to food and beverage container nesting devices used for preventing contact between one container and another one stacked above or adjacent to it.

BACKGROUND OF THE INVENTION

The nature of food and beverage containers (including cookware) is such that scratching and chipping is likely when such containers are stacked upon or adjacent to each other. Additionally, if such containers bind together, it is difficult to separate them, without damaging the surface or structure.

Consequently, nesting devices are employed to prevent such occurrences. One example is liners which cover the surface of non-stick cookware to prevent pans from binding together. Otherwise, the metallic bottom of the stacked pan would cause abrasion of the non-stick surface of the above or adjacent pan.

U.S. Pat. No. 3,358,878 discloses a nesting accessory which requires an adjustable feature to accommodate containers of different shapes and sizes. The wedge style nesting device of U.S. Pat. No. 1,468,748 is also problematic because it requires several pieces to be spaced relatively uniformly along the container periphery so that the containers do not abrade. The devices employed for teflon pans are unsatisfactory because they have very large fields. Finally, the complicated leaf type device described in U.S. Pat. No. 955,883 would be impractical for convenient home use.

It is therefore an object of the present invention to provide a device that removes the danger of scratching and chipping as the food and beverage containers are stacked.

Another object of the invention to prevent food and beverage containers from binding together.

A further object of the invention is to provide a smaller, more flexible and economical nesting device compared to previously known devices, which were less practical due to their large, complicated or rigid forms.

SUMMARY OF THE INVENTION

These and other objects of this invention, which shall become apparent hereafter, are achieved by the food and beverage container nesting device ("separator") which comprises flexible spokes, intersecting at a base and optionally ball-shaped structures, hooks or a curved configuration at the ends of the spokes. The separator bends when placed into the container and the ball-shaped structures or tip hooks may rest on the rim, securing the separator. When a container is stacked, the separator prevents it from coming into contact with another container.

DETAILED DESCRIPTION OF THE PREFERRED AND ALTERNATE EMBODIMENTS

Figure 1:
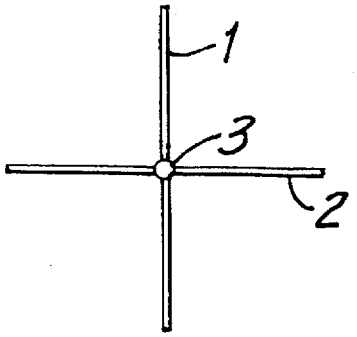
FIG. 1 is a top view of the separator in its original shape.
Figure 2:
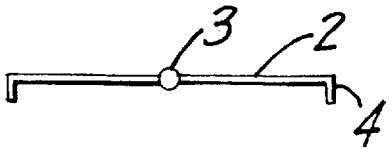
FIG. 2 is a side view of the separator in its original shape.
Figure 3:
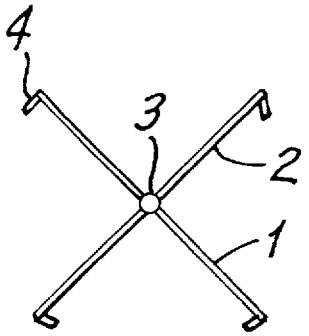
FIG. 3 is a ¾ perspective view of the separator in its original shape.

Referring to the drawings, wherein like numerals represent like elements throughout the various views, FIGS. 1–3 depict a food and beverage container nesting device ("separator") having two perpendicular spokes 1, 2 of equal length, comprised of a plastic or other flexible material which is preferably memory retaining.

The base 3 marks the center of the separator where the two spokes 1, 2 cross. Attached to the end of the spokes 1, 2 are, in a preferred embodiment, four tip hooks 4 of the same material, which are bent at such an angle so as to rest over the rim of a food or beverage container.

Figure 4:
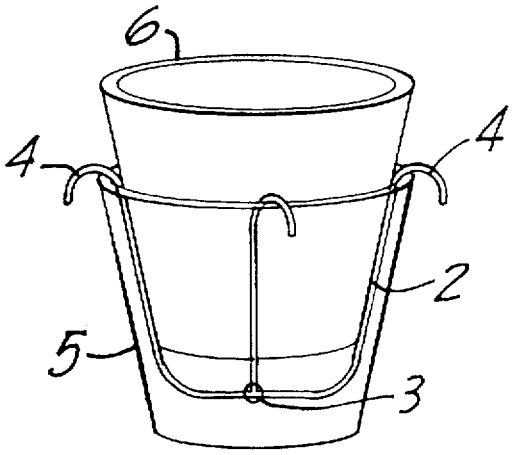
FIG. 4 is a perspective view of the separator illustrated in FIGS. 1–3, having been reshaped and placed into one glass, with another glass placed on top.

FIG. 4 illustrates the use of the separator shown in FIGS. 1–3. Glass 5 is on a shelf (not shown) and another glass 6 has been stacked above glass 5, with the separator placed in between. Note that the separator is now curved, rather than flat shaped to accommodate the shape of the glassware. The base 2 may rest on top of the base of glass 5, while the bottom of glass 6 may rest on top of the base 3. Similarly, the spokes 1, 2 rest in between and touch the interior of glass 5 and exterior of glass 6. The tip hooks 4 secure the separator in place as they hang over the rim of glass 5.

Figure 5:
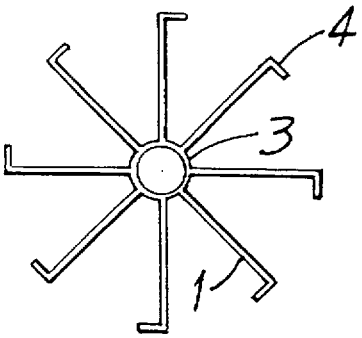
FIG. 5 illustrates a possible variation of the preferred embodiment, including more spokes and a larger base.
Figure 6:
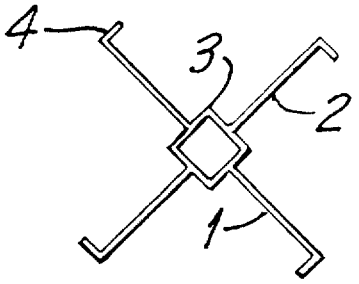
FIG. 6 illustrates another possible variation of the preferred embodiment, with a different size and shape base.
Figure 7:
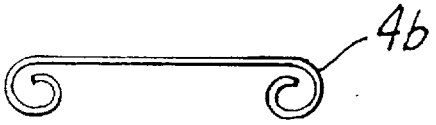
FIG. 7 illustrates a further possible variation of the preferred embodiment with a different hook configuration.

FIGS. 5–7 illustrate possible variations of the preferred embodiment of FIGS. 1–3. For example, in FIG. 5, there are four spokes 1, 2, 7, 8 rather than two, and a larger circular base 3. In FIG. 6, there are two spokes 1, 2, but a larger and rectangular base 3. FIG. 7 shows a variation on the tip hook in the form of a curled hook **4*b***.

Figure 8:
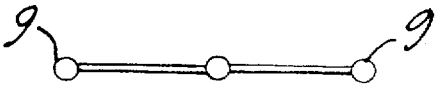
FIG. 8 illustrates another embodiment of the separator, but having ball-shaped structures at the ends of the spokes.
Figure 9:
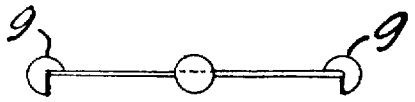
FIG. 9 shows a further embodiment of the separator, but having ¾ ball shaped structures at the ends of the spokes.
Figure 10:
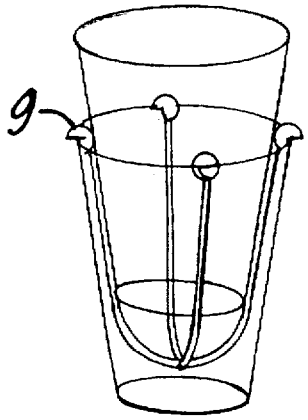
FIG. 10 shows the embodiment of the FIG. 9 separator in use.

FIG. 8 illustrates another embodiment of the separator, having ball-shaped structures 9 at the ends of the spokes. FIG. 9 shows a further embodiment of the separator, but having ¾ ball shaped structures 9 at the ends of the spokes. FIG. 10 shows the embodiment of FIG. 9 in use. The open quarter of the ball hangs on the lip of a lower glass or container.

Figure 11:
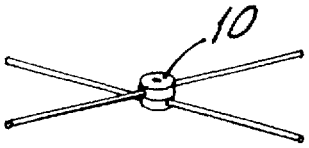
FIG. 11 shows the separator in a "closed" position, facilitating storaging and packaging thereof.

FIG. 11 shows the separator in a "closed" position, facilitating storaging and packaging thereof. In this embodiment, the base contains a rivet 10, which permits the spokes to be rotated and brought together into a parallel, "closed" position or into an intersecting "use" position. The closed position facilitates storing and packaging of the nesting device.

Figure 12:
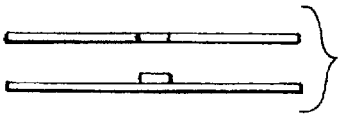
FIG. 12 is a side view of two spoke components of the separator, in which one component has a hole and the other component has a nipple attachment for attachment of the two components.
Figure 13:
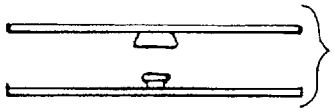
FIG. 13 is a side view of two spoke components of the separator, in which one component has a male snap and the other has a female snap for attachment of the two components.

FIG. 12 is a side view of two spoke components of the separator, in which one component has a hole and the other component has a nipple attachment for attachment of the two components. FIG. 13 is a side view of two spoke components of the separator, in which one component has a male snap and the other has a female snap for attachment of the two components.

Figure 14:
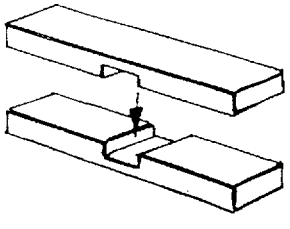
FIG. 14 is a perspective view of another embodiment of the two spoke components in which each component has complementary rectangular cutouts to permit mating of the two components.

FIG. 14 is a perspective view of another embodiment of the two spoke components in which each component has complementary rectangular cutouts to permit mating of the two components.

Figure 15:
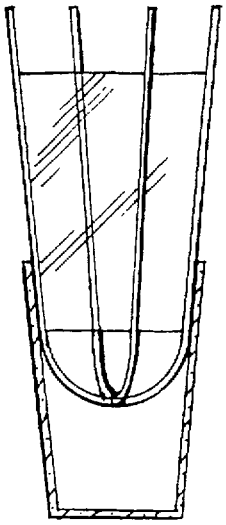
FIG. 15 depicts yet another embodiment of the invention in use.

FIG. 15 depicts yet another embodiment of the invention in use. In this embodiment, the spokes are substantially long and can be cut down to size.

Other possible features could include reinforced tip hooks, rubber coated plastic, and different colors.

While the preferred and alternate embodiments of the invention have been depicted in detail, modifications and adaptations may be made thereto, without departing from the spirit and scope of the invention, as delineated in the following claims:

What is claimed is:

1. A container nesting device for supporting a plurality of containers one container above another in a spaced relationship, said device, comprising:

a base having a size which is substantially smaller than inner or outer bottom surfaces of a container; and a plurality of resilient flexible spokes emanating from and forming said base; and end means on at least one end of a spoke for ease of holding or removal of said device.

2. The device of claim 1, further comprising projections emanating from the spokes.

3. The device of claim 2, further comprising a rivet at the base.

4. The device of claim 2, wherein said projections are hooks.

5. The device of claim 4, wherein said hooks extend perpendicular to the axis.

6. The device of claim 2, wherein said projections are spherical.

7. The device of claim 2, wherein said projections are ¾ spherical.

8. The device of claim 4, wherein said hooks curl inward.

9. The device of claim 1, wherein said base is circular.

10. The device of claim 1, wherein said base is rectangular.

11. The device of claim 1, wherein one of said spokes has a hole and the other has a nipple attachment.

12. The device of claim 1, wherein one of said spokes has a male snap and the other has a female snap.

13. The device of claim 1, wherein each spoke has complementary rectangular cutouts to facilitate the mating thereof.

14. The device of claim 1, wherein each spoke is substantially long and may be cut to a desired size.

15. A nesting separator for supporting two containers to be nested one within another, said nesting separator, comprising:

a plurality of resilient flexible spokes connected with each other and having base portions, formed at the intersection of said spokes, for forming a nesting separator base for supporting the one container within the another container, wall portions forming continuation of the base portions and bendable relative to the base portions for forming a nesting separator wall, wherein said base is substantially smaller than inner or outer bottom surfaces of a container; and end portions forming continuation of the wall portions and bendable relative to the second portions for forming hook-type means for supporting said nesting separator on the another container, said spokes being connected with each other at the base portions thereof.

* * * * *